US006457817B1

(12) United States Patent
Kotaki

(10) Patent No.: US 6,457,817 B1
(45) Date of Patent: Oct. 1, 2002

(54) INK JET HEAD, INK JET CARTRIDGE, INK JET APPARATUS, AND METHOD OF MANUFACTURING THE SAME INK JET HEAD

(75) Inventor: Yasuo Kotaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/465,388

(22) Filed: Dec. 17, 1999

(30) Foreign Application Priority Data

Dec. 24, 1998 (JP) ..... 10-367218

(51) Int. Cl.[7] ..... B41J 2/045; B41J 2/05
(52) U.S. Cl. ..... 347/71; 347/65
(58) Field of Search ..... 347/68, 71, 65, 347/58

(56) References Cited

U.S. PATENT DOCUMENTS 5,097,274 A 3/1992 Drake et al. ..... 347/42
5,596,357 A 1/1997 Terai ..... 347/64
5,784,079 A * 7/1998 Masuda et al. ..... 347/20
6,086,187 A * 7/2000 Hattori et al. ..... 347/63

FOREIGN PATENT DOCUMENTS

DE 4040713 5/1991

* cited by examiner

*Primary Examiner*—Thinh Nguyen
(74) *Attorney, Agent, or Firm*—Fitzpatrick, Cella, Harper & Scinto

(57) ABSTRACT

An ink jet head composed of a top plate having grooves for forming a plurality of ink passages in an arranged condition and a recess section for forming a liquid chamber communicating with the ink passages and a base plate for establishing the plurality of ink passages and the liquid chamber in a state joined to the top plate. On the base plate, ejection energy generating elements are placed for ejecting an ink. In addition, a supporting member is used for supporting a surface of the base plate opposite to a surface thereof on which the ejection energy generating elements lie. The supporting member is made of a ceramic burned material. This construction is capable of joining the base plate and the supporting member smoothly in parallel with each other so that the ejection energy generating elements are accurately aligned with the plurality of ink passages made on a top plate to achieve a high-quality recording without the occurrence of troubles such as poor ink impact on a record medium.

52 Claims, 22 Drawing Sheets

HB UNIT FIXING STATE

HB UNIT FIXING JIG
(MATERIAL : SUS304)

HB UNIT FIXING STATE

INK JET HEAD, INK JET CARTRIDGE, INK JET APPARATUS, AND METHOD OF MANUFACTURING THE SAME INK JET HEAD

BACKGROUND OF THE INVENTION

1. Field of the Invention

The present invention relates to an ink jet head comprising a top plate having a plurality of grooves arranged for forming ink passages and having a recess section for defining a liquid chamber communicating with the ink passages, a base plate (or a substrate) for forming the plurality of ink passages and the liquid chamber in a state joined to the top plate, ejection energy generating elements placed on the base plate for discharging inks and a supporting member for supporting the base plate at a surface of the base plate opposite to the surface thereof on which the ejection energy generating elements lie, and further relates to an ink jet cartridge equipped with this type of ink jet head and to an ink jet apparatus.

2. Description of the Related Art

An ink jet type apparatus is made to let fly ink droplets from microscopic discharge openings made in an ink jet head to a record medium, thereby accomplishing desired recording.

As recording apparatus designed to make recording on a record medium such as paper, cloth, plastic sheets and OHP sheets, there have been proposed apparatus of various recording types such as a wire dot type, a thermal recording type, a thermal transfer type and an ink jet type. Of these types, an ink jet type recording apparatus (ink jet apparatus) is applicable to an output means of an information processing system, such as a printer serving as an output terminal of a copying machine, a facsimile, an electronic typewriter, a word processor, a workstation or the like, alternatively a handy or portable type printer to be set in a personal computer, a host computer, a disk unit, a video unit or the like, and has been put on the market.

Furthermore, among ejection energy generating elements to be provided in an ink jet head of the aforesaid ink jet apparatus for generating energy to discharge an ink from ejection openings, for example, there are a type of using an electromechanical transducer such as a piezo element, a type of emitting an electromagnetic wave such as laser to generate heat for discharging ink droplets by the generated heat and a type of heating a liquid by an electrothermal converting element including a heat-generating resistor for discharging ink droplets.

In the recent years, with the progress of software and computers, the ink jet apparatus has been required to output color images, so that an ink jet head thereof has been designed to conducting the coloring processing according to these circumstances. The means employed currently therefor includes a multiple color head constructed by assembling single-color heads and further includes a multi-color head depending upon the ink jet head manufacturing method.

In addition to this coloring situation, a high fineness of the image output is also required, so that the ink jet type has been made to realize a higher fineness and a higher image quality through higher printing density and ink concentration variation.

Referring to FIGS. 3 to 8, a description will be given hereinbelow of one example of the aforesaid ink jet head.

FIG. 3 is an exploded perspective view schematically showing one example of an ink jet head applicable to the aforesaid ink jet type, and FIG. 4 is a perspective view showing a state in which the ink jet head shown in FIG. 3 is assembled.

Furthermore, FIG. 5 is a top view showing the ink jet head of FIG. 4 when viewed from an ejection opening arranged surface, and FIG. 6 is a cross-sectional view showing the ink jet head of FIG. 4, taken along a line A–A' in FIG. 4, FIG. 7 is an enlarged view showing a joint portion between a base plate and a supporting member in FIG. 6, and FIG. 8 is a detailed illustration of a portion indicated at B in FIG. 6.

In the illustrations, reference numeral 3 represents a base plate, with a conventional base plate being commonly made of a silicon. On the base plate 3, there are provided a plurality of ejection energy generating elements (for example, electrothermal converting elements) 7 for ejection of inks. The base plate 3 is joined to a top plate in which grooves for forming a plurality of ink passages 9 and a recess section for forming a liquid chamber 10 are made according to a molding technique or the like, thereby defining the ink passages 9 and the liquid chamber 10. For sealing, a sealing material (not shown) is placed around the ink passages 9 and the liquid chamber 10 defined by the top plate 2 and the base plate 3 to prevent the occurrence of short-circuit by the flow of the ink to electrical junctions due to the ink leakage. Additionally, an orifice plate 16 having ink ejection openings 8 is integrated with the top plate 2. The base plate 3 and the top plate 2 are fixed to each other in a state pressed by a pressing member such as a spring. Still additionally, a supporting member 13 is installed on a surface of the base plate 3 opposite to the surface thereof on which the ejection energy generating elements 7 exist. Furthermore, numeral 4 depicts a wiring substrate connected electrically through lead wires to the ejection energy generating elements 7 disposed on the base plate 3, and the wiring substrate 4 is fixedly secured to the supporting member 13 by a UV adhesive 11 applied onto a V-shaped groove having a V-like configuration in cross section and made in a surface of the supporting member 13 coming into contact with the wiring substrate 4. Still furthermore, numeral 6 denotes a contact pad for communicating an electric signal from the ink jet apparatus to the wiring substrate 4, which is placed on the wiring substrate 4. The aforesaid sealing material is also used for the electrical junctions between the base plate 3 and the wiring substrate 4 to protect them by the prevention of ink adhesion.

In the ink jet head thus constructed, it is preferable that the plurality of ejection energy generating elements disposed on the base plate and the plurality of ink passage grooves made in the top plate are aligned accurately with each other. Accordingly, there is a need to assemble the top plate and the base plate with high precision, and it is desirable that the top plate and the base plate are joined smoothly in parallel with each other for excellent ink impact.

That is, in the case in which the base plate and the top plate are not joined smoothly in parallel with each other because the base plate is distorted with respect to the top plate or because the base plate is largely tilted relative to the top plate, of the ink passages defined by joining the base plate and the top plate, a gap appears between the adjacent ink passages with respect to the base plate so that the ejection pressure developed by the ejection energy generating elements is dispersed to the adjacent ink passage. In such a case, if the ink ejection quantity varies at a poor adhesion portion of the ink passages defined by joining the base plate and the top plate or if meniscus vibrations occur, the ink ejection speed becomes unstable at recording or the impact accuracy drops to cause the printing to fall into disorder easily so that difficulty is encountered in achieving high-quality recording.

As mentioned above, for the top plate and the base plate to be joined smoothly in parallel with each other, a point is that the base plate and the supporting member for supporting the base plate are joined smoothly in parallel with each other. However, so far, there has been a case in which the base is not joined smoothly in parallel with the supporting member supporting the base plate, and this reason is that the base plate is distorted in the arranging direction of the ejection energy generating elements and the base plate is tilted with respect to the top plate.

Referring to FIG. 9, a description will be given hereinbelow of the case in which the base plate is distorted in the arranging direction of the ejection energy generating elements. FIG. 9 shows a state in which, in the case of the conventional supporting member made from aluminum, the supporting member and the base plate are joined to each other by a high-temperature cure of a thermal conductivity adhesive, viewed from the ejection opening arranging surface side.

In FIG. 9, the base plate 3 on which the ejection energy generating elements are disposed is joined to the supporting member 13 by the high-temperature cure of the thermal conductivity adhesive 12, and the cure temperature at this time is as high as approximately 120° C. to 150° C. Accordingly, since the linear expansion coefficient of the supporting member 13 made from aluminum is extremely larger as compared with the linear expansion coefficient of the base plate made of a silicon, the rates of the contraction of the supporting member 13 and the base plate 3 differ from each other when it is returned to the ordinary (room) temperature, and distortion can occur in the arranging direction of the ejection energy generating elements of the base plate as shown in FIG. 9.

In addition, in the case in which electrothermal converting elements are employed as the ejection energy generating elements provided on the base plate in meeting relation the ink passages, when the arrangement density of the electrothermal converting elements becomes high, the heat generated from the electrothermal converting elements increases at printing. Accordingly, depending upon the arrangement density of the electrothermal converting elements, the temperature of the surface of the base plate opposite to the electrothermal converting element arranging surface approaches 100° C. Thus, also in the case in which the difference in temperature between the base plate and the supporting member is large at printing and non-printing at printing and non-printing, due to the difference in linear expansion coefficient between the base plate made of silicon and the supporting member made from aluminum, distortion can occur in the ejection energy generating element arranging direction of the base plate.

Furthermore, referring to FIG. 11, a description will be made hereinbelow of the case in which the top plate and the base plate cannot be joined smoothly in parallel with each other since the base plate is tilted with respect to the top plate as mentioned above. FIG. 11 is an enlarged illustration of a joint between the base plate in FIG. 6 and the conventional supporting member made from aluminum. Since, in a method of manufacturing the supporting member 13, the conventional aluminum-made supporting member 13 is pressing-processed, the so-called shear drop 14 signifying a rounded corner portion or the so-called burr 15 signifying a projection occurs as shown in FIGS. 10C and 10D. Assuming that the burr 15 occurs on a surface of the supporting member 13 coming into contact with the base plate 3, as shown in FIG. 11, the burr 15 produces a gap with respect to the base plate 3, and the distance between the base plate 3 and the supporting member 13 can be E1>E2. Additionally, in such a case, since the distance from the base plate 3 to the supporting member 13 is not uniform, the thermal conductivity adhesive 12 gathers in the gap produced by the aforesaid projection, which makes it difficult to apply the thermal conductivity adhesive 12 evenly.

SUMMARY OF THE INVENTION

Accordingly, the present invention has been developed in consideration of these situations, and it is an object of the invention to provide an ink jet head capable of joining a base plate and a supporting member smoothly in parallel with each other so that a plurality of ejection energy generating elements provided on the base plate are accurately aligned with a plurality of ink passages made on a top plate to achieve a high-quality recording without the occurrence of poor ink impact on a record medium, and to provide a manufacturing method capable of producing the ink jet head at a high yield, and further to provide an ink jet cartridge equipped with the ink jet head and an ink jet apparatus equipped with the ink jet cartridge.

For achieving this purpose, in accordance with this invention, there is provided an ink jet head comprising a top plate having grooves for forming a plurality of ink passages in an arranged condition and a recess section for forming a liquid chamber communicating with the ink passages, a base plate for establishing the plurality of ink passages and the liquid chamber in a state joined to the top plate, ejection energy generating elements placed on the base plate for ejecting an ink, and a supporting member for supporting a surface of the base plate opposite to the surface thereof on which the ejection energy generating elements lie, wherein the supporting member is made of a ceramic burned material.

In addition, in accordance with this invention, there is provided a method of manufacturing an ink jet head including a top plate having grooves for forming a plurality of ink passages in an arranged condition and a recess section for forming a liquid chamber communicating with the ink passages, a base plate for establishing the plurality of ink passages and the liquid chamber in a state joined to the top plate, ejection energy generating elements placed on the base plate for ejecting an ink, and a supporting member for supporting a surface of the base plate opposite to the surface thereof on which the ejection energy generating elements lie, the method comprising a step of producing the supporting member by burning a ceramic.

According to this invention, since the difference in linear expansion coefficient between the ceramic burned material and the silicon forming the material of the base plate is considerably less than that between the silicon and the aluminum used so far, when the base plate and the supporting member are adhered to each other by a high-temperature cure and returned to the ordinary temperature, the contraction rates of the supporting member and the base plate become substantially equal to each other and the expansion rates of the supporting member and the base plate becomes substantially equal to each other even when the difference in temperature between non-printing and printing is large due to an increase in arrangement density of the electrothermal converting elements serving as the ejection energy generating elements, so that the supporting member and the base plate can be joined smoothly in parallel with each other.

Additionally, since the supporting member has no shear drop nor burr and has a uniformly formed burned surface, the supporting member and the base plate can joined smoothly in parallel with each other so that the thermal conductivity adhesive can be applied evenly onto a portion between supporting member and the base plate. Thus, this invention can solve the above-mentioned problems.

BRIEF DESCRIPTION OF THE DRAWINGS

The object and features of the present invention will become more readily apparent from the following detailed description of the preferred embodiments taken in conjunction with the accompanying drawings in which.

DESCRIPTION OF THE PREFERRED EMBODIMENTS

The present invention will be described in detail hereinbelow with reference to FIGS. 1 and 12 to 17.

Figure 1:
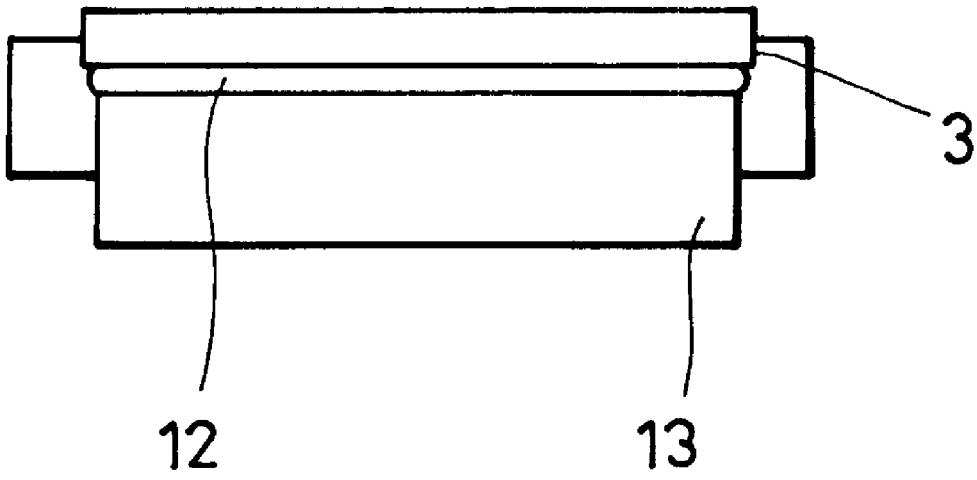
FIG. 1 shows a state in which a base place and a supporting member according to this invention are joined to each other by a high-temperature cure and brought back to the ordinary temperature, viewed from the ejection opening disposition surface side.

FIG. 1 is a state illustration of a base plate and a supporting member according to this invention, viewed from an ejection opening disposition surface.

Figure 12:
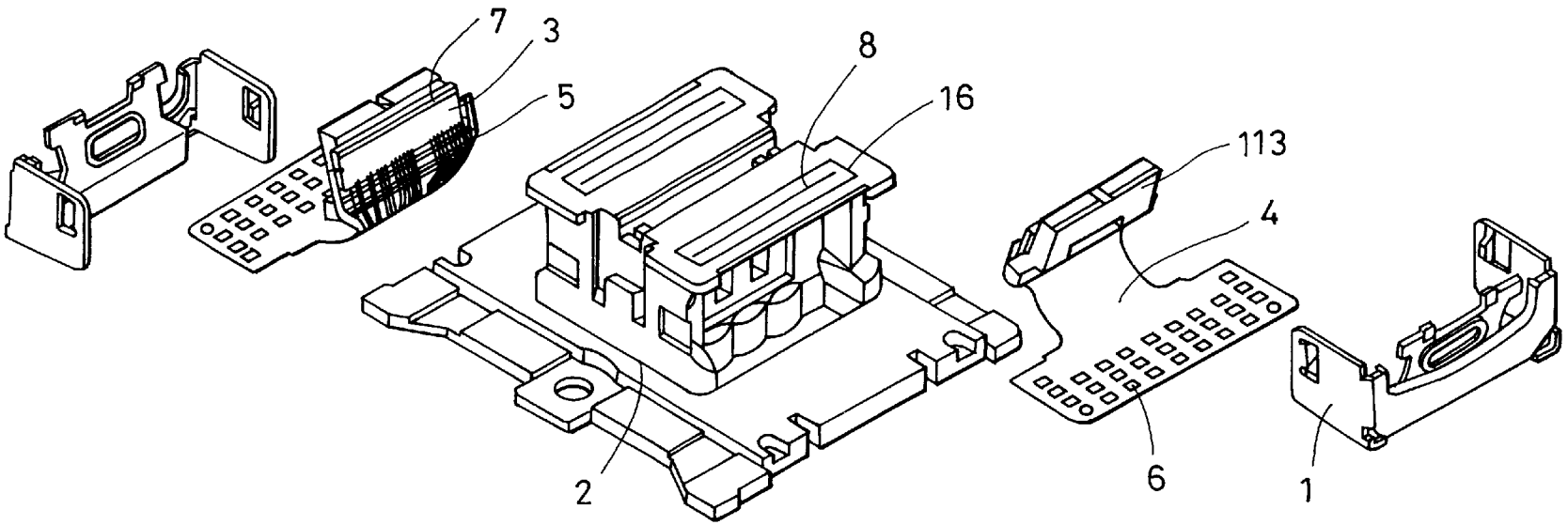
FIG. 12 is an exploded perspective view schematically showing a portion of an ink jet head according to this invention.
Figure 13:
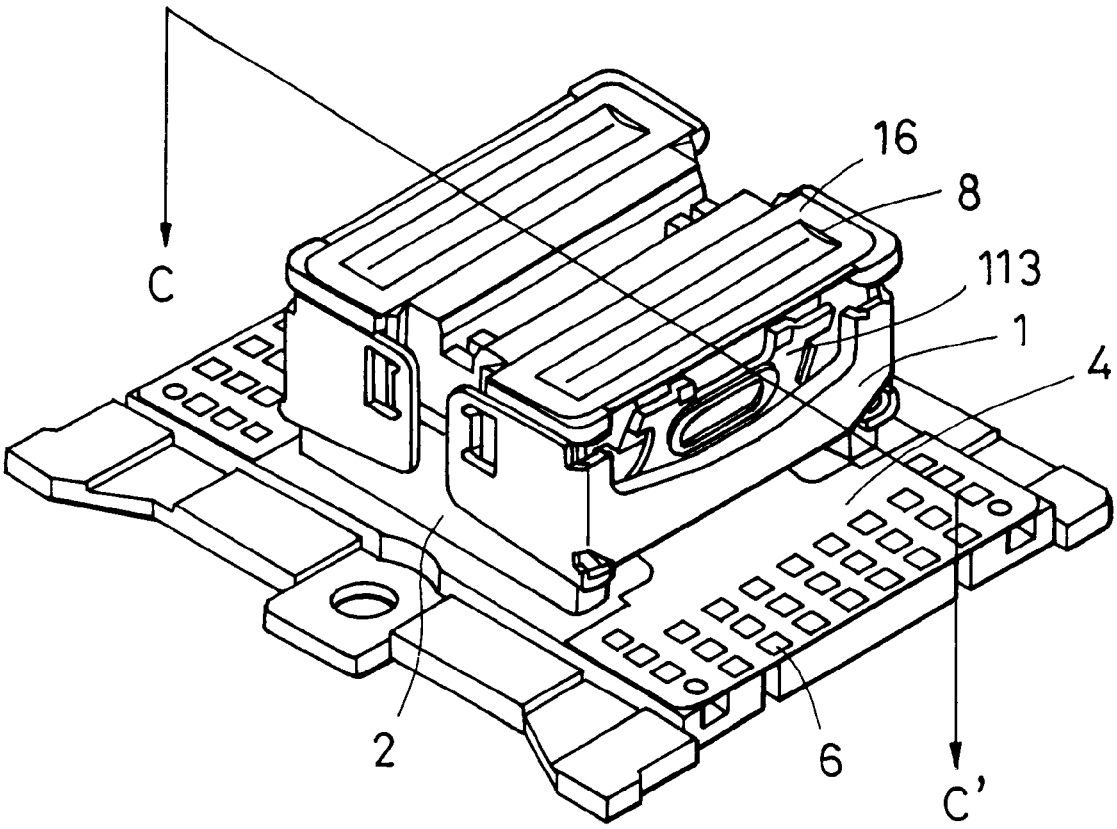
FIG. 13 is a perspective view showing an assembly of a portion of the ink jet head according to this invention.

FIG. 12 is an exploded perspective view schematically showing an ink jet head according to this invention, and FIG. 13 is a perspective view showing an assembly of the ink jet head shown in FIG. 12.

Figure 14:
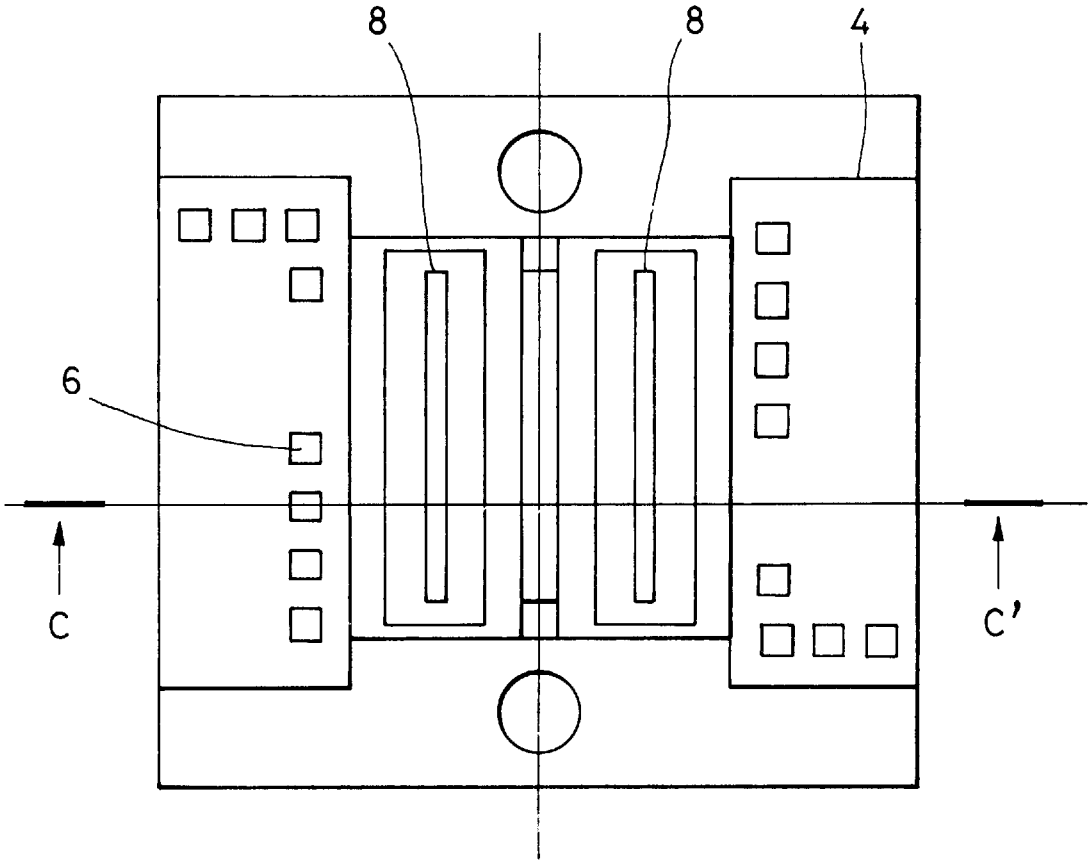
FIG. 14 is a top view showing the ink jet head according to this invention, viewed from the ejection opening disposition surface.
Figure 15:
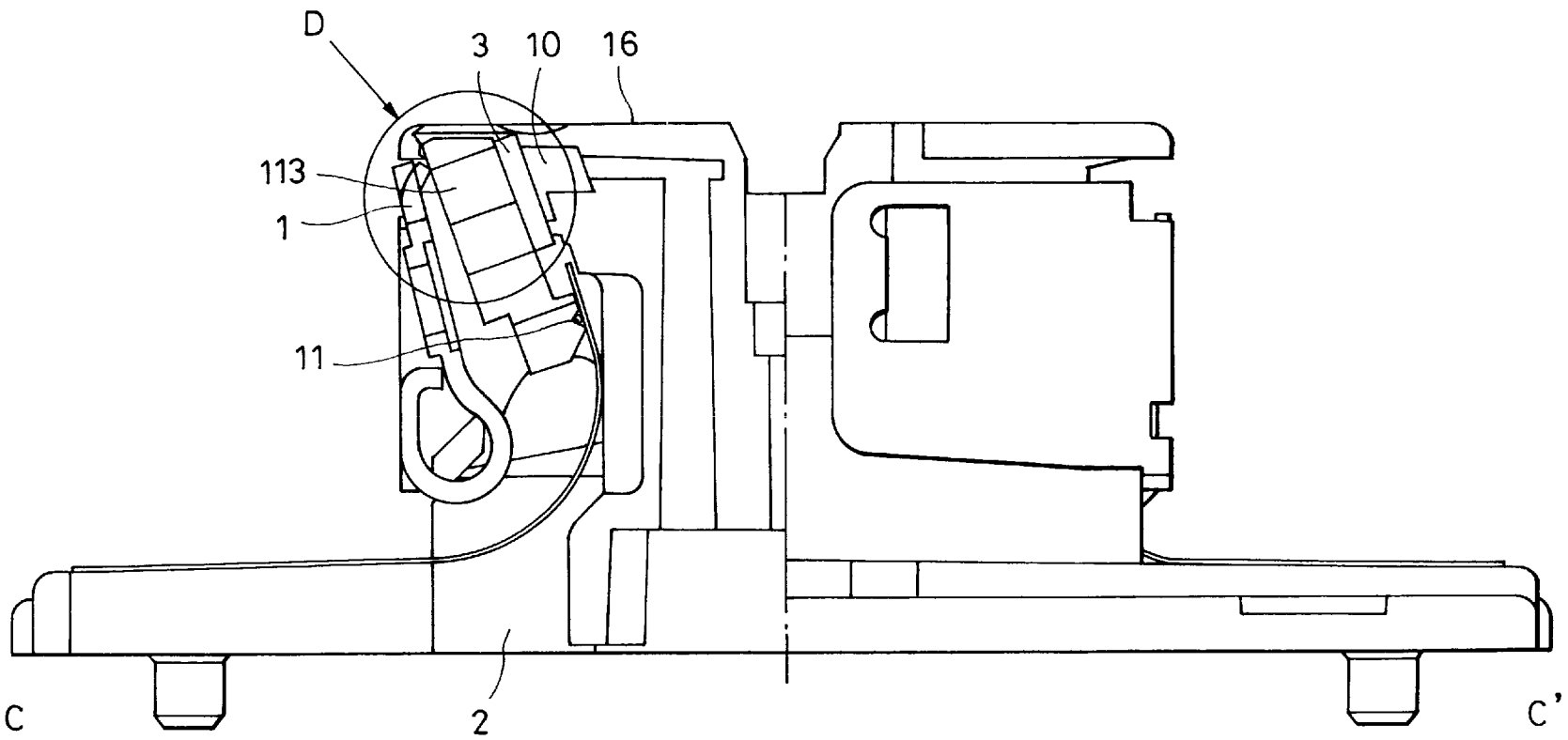
FIG. 15 is a cross-sectional view showing the ink jet head according to this invention, taken along a C–C' line of FIG. 13.

FIG. 14 is a top view showing the ink jet head of FIG. 13, viewed from an ejection opening disposition surface, and FIG. 15 is a cross-sectional view showing the ink jet head of FIG. 13, taken along a line C–C'.

Figure 16:
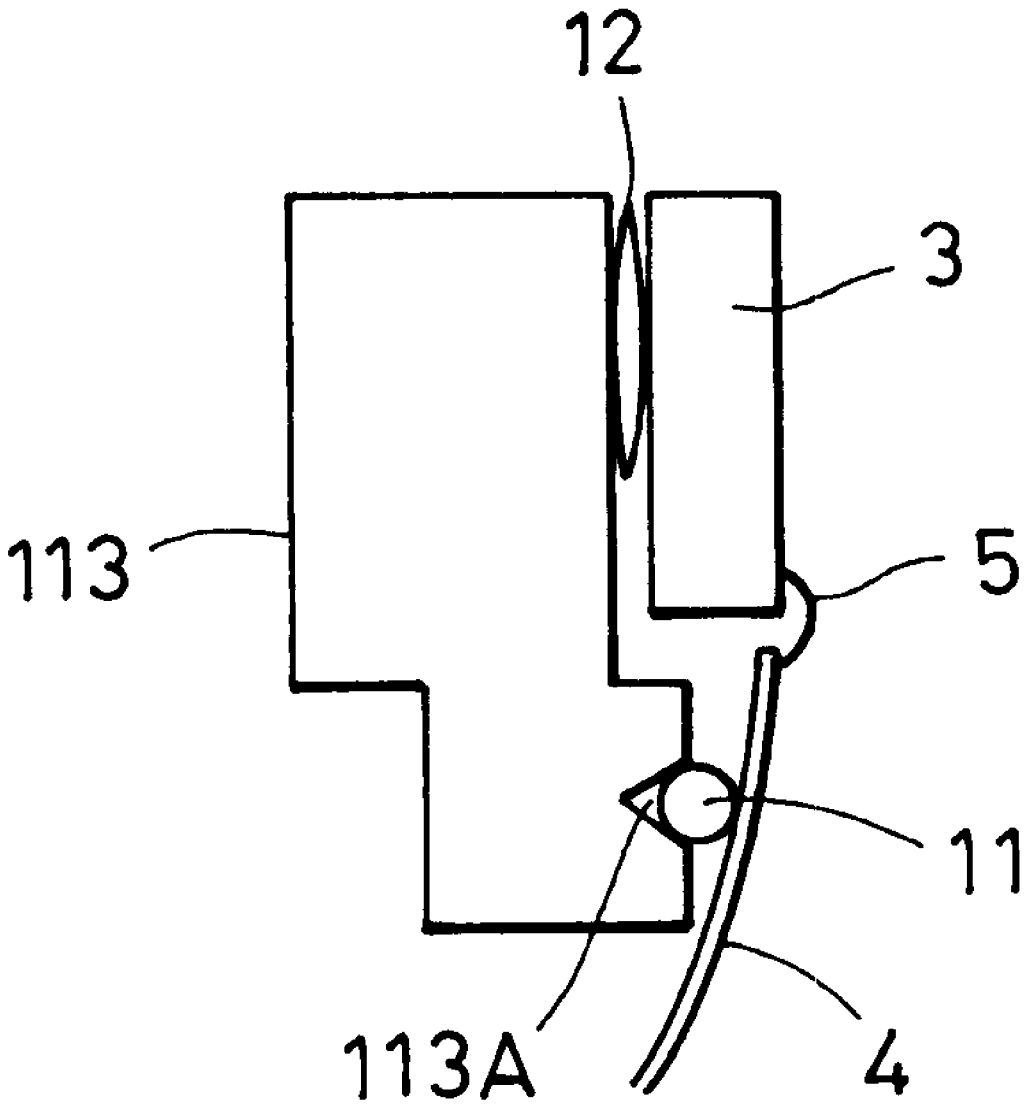
FIG. 16 is an enlarged view showing a joint between a base plate and a supporting member in the C–C' line cross section of FIG. 15.
Figure 17:
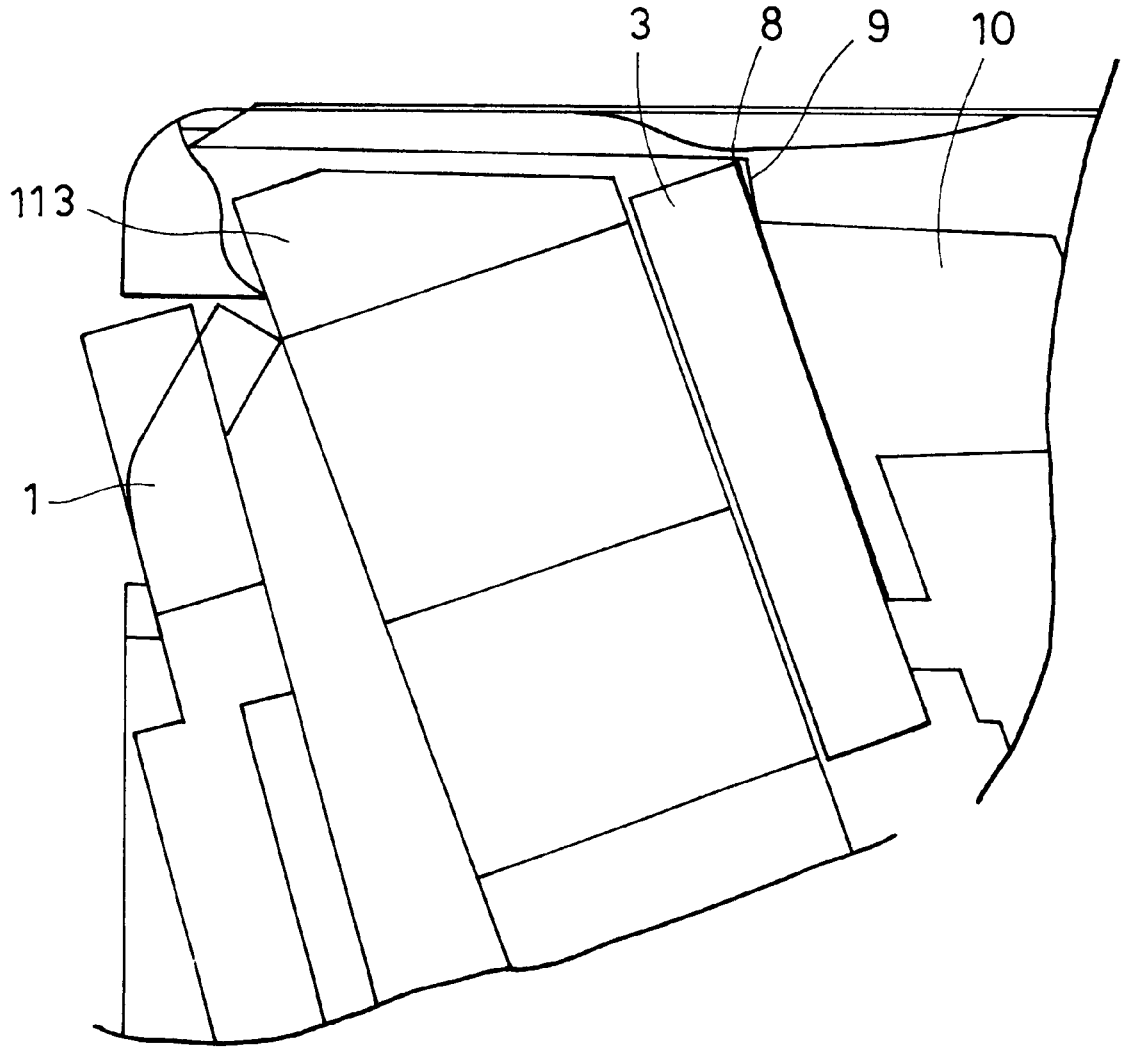
FIG. 17 is a detailed view showing a D portion of the ink jet head according to this invention in the C–C' cross section of FIG. 15.
Figure 18A:
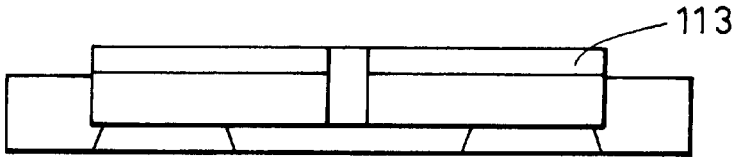
FIG. 18A shows a supporting member of the ink jet head according to this invention, viewed from the ejection opening disposition surface side.
Figure 18B:
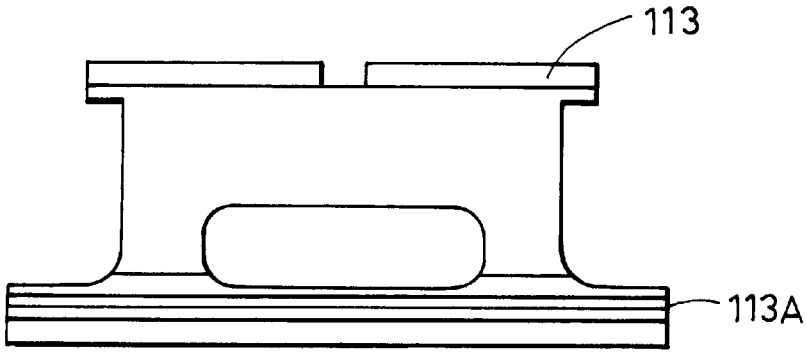
FIG. 18B shows the supporting member of the ink jet head according to this invention, viewed from a surface thereof contacting with the base plate.
Figure 18C:
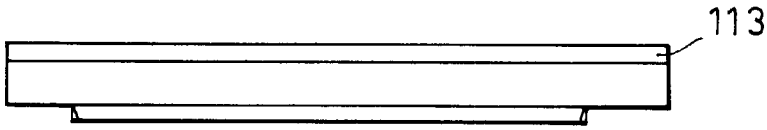
FIG. 18C shows the supporting member of the ink jet head according to this invention, viewed from a surface opposite to the ejection opening disposition surface.
Figure 18D:
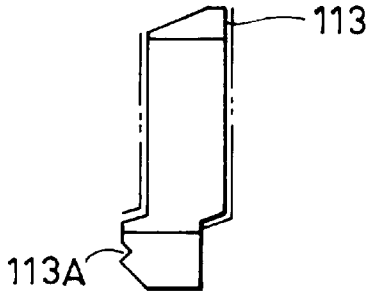
FIG. 18D is a cross-sectional view showing the supporting member of the ink jet head according to this invention, taken perpendicularly to an ejection energy generating element array.

FIG. 16 is an enlarged view showing a joint between a base plate and a supporting member shown in FIG. 15, and FIG. 17 is a detailed illustration of a D portion shown in FIG. 15.

In the illustrations, numeral 3 represents a silicon-made base plate on which a plurality of ejection energy generating elements 7 (for example, electrothermal converting elements) are provided to eject an ink. The base plate 3 has grooves for a plurality of ink passages 9 and a recess section for a liquid chamber 10 which define the plurality of ink passages 9 and the liquid chamber 10, respectively, when the base plate 3 is joined with a top plate 2 formed by molding or the like. The portions around the ink passages 9 and the liquid chamber 10, defined by the top plate 2 and the base plate 3, are sealed by a sealing material (not shown) for preventing the occurrence of short circuits due to electrical connection of the ink to a joint caused by ink leakage. Furthermore, numeral 8 designates ink ejection openings for ejection of the ink, with the ink being supplied from the liquid chamber 10 through the ink passages 9 communicating with the ink ejection openings 8. Numeral 113 denotes a supporting member adhered through an Ag containing epoxy thermal conductivity adhesive forming a thermal conductivity adhesive 12 to the rear surface (holding the ejection energy generating elements) of the base plate 3. The base plate 3 is pressed through the supporting member 113 against the top plate 2 by means of a pressing member such as a spring designated at numeral 1 to be joined to the top plate 2. Additionally, the supporting member 113 is brought into contact with the rear surface of the base plate 3 to exhibit a function to radiate the heat generated from the ejection energy generating elements 7. Numeral 4 denotes a wiring substrate connected electrically through lead wires to the ejection energy generating elements 7. This wiring substrate 4 is fixedly secured to the supporting member 113 through an UV adhesive 11 applied to a V-shaped groove made in a surface thereof contacting with the wiring substrate 4. The quantity of coating of the UV adhesive 11 is determined on the basis of the volume of the V-shaped groove section made in the surface of the supporting member 113 facing the wiring substrate 4. Numeral 6 depicts a contact pad for communicating an electric signal from the ink jet apparatus to the wiring substrate 4, which is placed on the wiring substrate 4. Additionally, the sealing material is also used for the electrical joint between the base plate 3 and the wiring substrate 4 to protect it from ink adhesion.

Incidentally, the top plate 2 is equipped integrally with an orifice plate 16 including the ink ejection openings 8, and the recess section for the formation of the ink chamber 10 and the ink introduction passage are also made by molding. Additionally, for high-accuracy processing, the ink ejection openings 8 and the grooves for the ink passages 9 are processed by laser. Still additionally, the aforesaid top plate 2 is required to be made of a material which shows an excellent molding property because of integrated molding and which has a hard-to-attack characteristic. Concretely, a polyfulphon is used as this material. It is also possible to use other molding materials as long as they can meet the aforesaid requirements.

Furthermore, in a case in which electrothermal converting elements are used as the plurality of ejection energy generating elements 7 to be provided on the base plate 3 made of silicon, the thermal energy generated from the plurality of ejection energy generating elements 7 causes the film boiling to eject the ink from the ink passages 9. Additionally, on the base plate 3, electric wires made of aluminum or the like are formed by a film forming technique to supply power to the ejection energy generating elements 7. Still additionally, shift registers and drive transistors are incorporated thereinto for decreasing the number of pads for the wiring substrate.

According to this invention, in order for the base plate to be joined smoothly in parallel with the supporting member, in plate of the conventional aluminum, a ceramic burned material is used for construction of the supporting member. This ceramic burned material can extremely reduce the difference in linear expansion coefficient from the silicon forming the material of the base plate, as compared with aluminum. Among the ceramic burned materials, for example, there are aluminum oxide, aluminum nitride, and other materials. In the case in which the aluminum is used as the aforesaid ceramic burned material, for effective radiation of the heat generated from the ejection energy generating elements on the base plate, it is preferable that the purity is above 80.00%.

As described above, with the construction according to this invention, in the case in which the base plate and the supporting member are joined to each other through an Ag containing epoxy adhesive forming a thermal conductivity adhesive according to a high-temperature cure of 120° C. to 150° C. and then brought back to the ordinary temperature, and in the case in which the arrangement density of the ejection energy generating elements, such as electrothermal converting elements, provided on the base plate in correspondence with the ink passages increases so that the heat generated from the electrothermal converting elements at printing becomes higher to increase the difference in temperature between the non-printing and the printing, the distortion resulting from the difference in linear expansion coefficient between the supporting member and the base plate decreases. Accordingly, the supporting member 113 and the base plate 3 can be joined smoothly in parallel with each other as shown in FIG. 1, and the top plate having the ink passage grooves and the base plate having the ejection energy generating elements can be aligned accurately with each other to accomplish the joint therebetween without defining a gap, which can provide an ink jet head capable of achieving high-quality recording without causing poor ink impact on a record medium, and which permits manufacturing the ink jet head at a high yield.

In addition, according to this invention, since the ceramic-burned-material-made supporting member is produced by burning a material taken out from a shaping mold, as shown in FIGS. 18A to 18D, it is possible to present a uniform formed burned surface not having shear drops or burrs. Still additionally, there is no need to machine it into an appropriate dimension after the burning. Also, since it is possible to remove the attached substances existing on the surfaces of the supporting member 113 before the burning by burning at a high temperature of 1500° C., there is no need to clean the surface of the supporting member after the molding. Thus, according to this invention, it is possible to decrease the number of steps to be taken for manufacturing, which facilitates the fabrication of the ink jet head.

Still additionally, as described above, since the ceramic-burned-material-made supporting member 113 according to this invention can have a uniform formed burned surface with no attached substances, it is possible to apply the Ag containing epoxy adhesive forming the thermal conductivity adhesive 12 to between the supporting member 113 and the base plate 3; therefore, the supporting member 113 and the base plate 3 can be joined smoothly in parallel with each other as shown in FIG. 16. Moreover, since the ceramic burned material constituting the supporting material 113 is porous, at the adhesion between the supporting member 113 and the base plate 3, the thermal conductivity adhesive 12 is included in the ceramic burned material, which can enhance the adhesion between the base plate 3 and the supporting member 113.

Furthermore, in the ink jet head having the construction in which the base plate 3 and the top plate 2 are fixedly pressed against each other by the use of the pressing member 1 as shown in FIG. 15 so that the ink passage disposition sections of the base plate 3 and the top plate 2 are aligned with each other, if large distortion of the base plate 3 occurs, the ink passage disposition section of the top plate 2 is partially pressed strongly to cause deformation of the ink passage walls. However, according to this invention, since the supporting member 113 and the base plate 3 can be joined smoothly in parallel with each other, the base plate 3 and the top plate 2 are pressed in a parallel and smooth condition so that the ink passage disposition section of the top plate 2 is not partially pressed strongly, which prevents the deformation of the ink passages 9. Additionally, the pressing force by the pressing member 1 can be dispersed over the entire ink passage 9 disposition section, which can eliminate the need for increasing the pressing force of the pressing member 1 in excess of a force necessary.

In addition, owing to this invention, also in the case of the ink jet head in which the supporting member and the wiring substrate are joined to each other through a UV adhesive as shown in FIG. 16, since the shear drops or burrs do not occur on a V-shaped groove 113A of the supporting member 113, whose cross section has a V-like configuration, as shown in FIG. 18, it is possible to uniformize the amount of coating of the UV adhesive 11 to be used for the fixing between the wiring substrate 4 and the supporting member 113. Accordingly, the fixing accuracy and fixing strength of the wiring substrate 4 improve, thus increasing the yield of the ink jet head.

The alignment of the base plate with the top plate is achievable by the precise alignment between the base plate and the supporting member. Accordingly, if the supporting member itself is aligned with the top plate, the base plate and the top plate can easily be aligned with each other. However, in the conventional art, since aluminium is press-molded for the formation of the supporting member, shear drops or burrs can occur which cause the deterioration of the positional accuracy between the base plate and the supporting member. Additionally, the removal of the burrs requires a chamfering process so that the number of processes increases. For this reason, in fact the alignment between the supporting member itself and the top plate has not been conducted.

According to this invention, by contrast, since the shear drops or burrs do not occur on the supporting member, the aforesaid chamfering process is not required. Accordingly, if a positioning member is provided on the supporting member to position the supporting member with respect to the top plate, the high-accuracy alignment between the base plate and the top plate becomes feasible without increasing the number of processes.

In addition, there has been known an ink jet head of the type in which a positioning section for positioning a head in mounting the head in an ink jet apparatus is provided in a supporting member and is used for mounting the ink jet head in the ink jet apparatus, and even in the case in which this invention is applied to such a head, it is possible to provide a supporting member with a high-accuracy positioning section without the need for the chamfering process so that the productivity and the yield are improvable.

Although, in the case of the conventional supporting member by the aluminium press processing, it is possible to change the thickness of the supporting member or can incline its surface through the secondary processing such as grinding, it is impossible to deal with complicated configurations. On the other hand, according to this invention, it is possible to change the thickness of the supporting member or to incline the surface easily by altering the pattern of the mold only.

Figure 19:
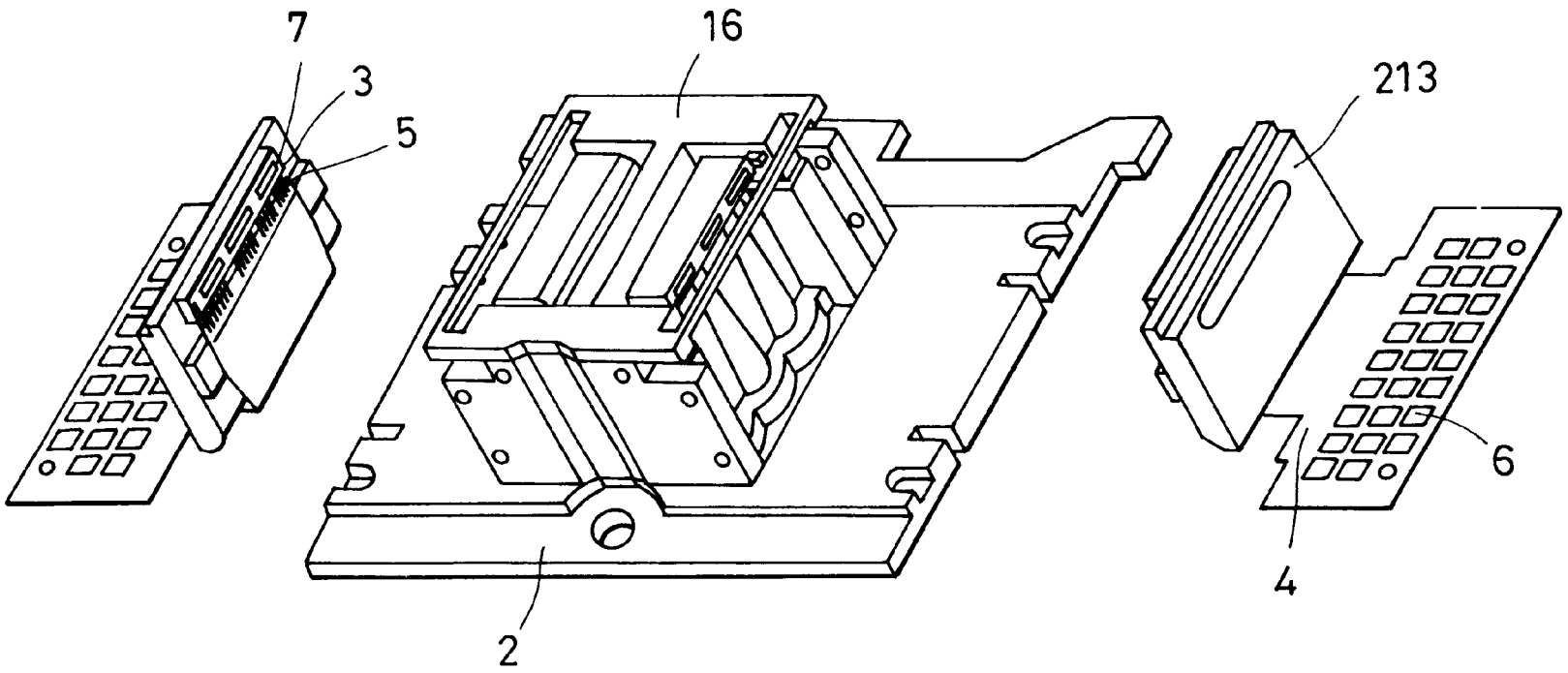
FIG. 19 is an exploded perspective view showing the ink jet head including one example of the supporting member having a positioning portion to a top plate.

Moreover, since the plurality of ejection energy generating elements 7 provided on the base plate 3 supported by the supporting member 213 and the grooves for the plurality of ink passages 9 made in the top plate can be aligned accurately in meeting relation to each other to define the ink passages 9, it is possible to effectively use the space, in which a pressing member has been located so far, for enlarging the surface area of the supporting member 213 as shown in FIG. 19, which enables the manufacturing of an ink jet head capable of improving the radiation effect.

Furthermore, although the ink passages 9 and the ink ejection openings 9 communicating with the ink passages 9 are integrated with each other in the above description of this invention, even in the case that the top plate having the ink passages 9 is formed separately from an orifice plate having the ink ejection openings 8 and they are joined to each other, the top plate and the base plate are joined smoothly in parallel with each other. Accordingly, the plurality of ejection energy generating elements existing on the base plate and the grooves for the plurality of ink passages in the top plate are aligned accurately in meeting relation to each other to establish the ink passages; therefore, it is possible to manufacture an ink jet head at a high yield, which is capable of achieving high-quality recording without the occurrence of poor ink impact on a record medium.

Still furthermore, in the above description, although the ink jet head has two rows of ejection openings arranged, this invention is not limited to this ejection opening arrangement.

Figure 2:
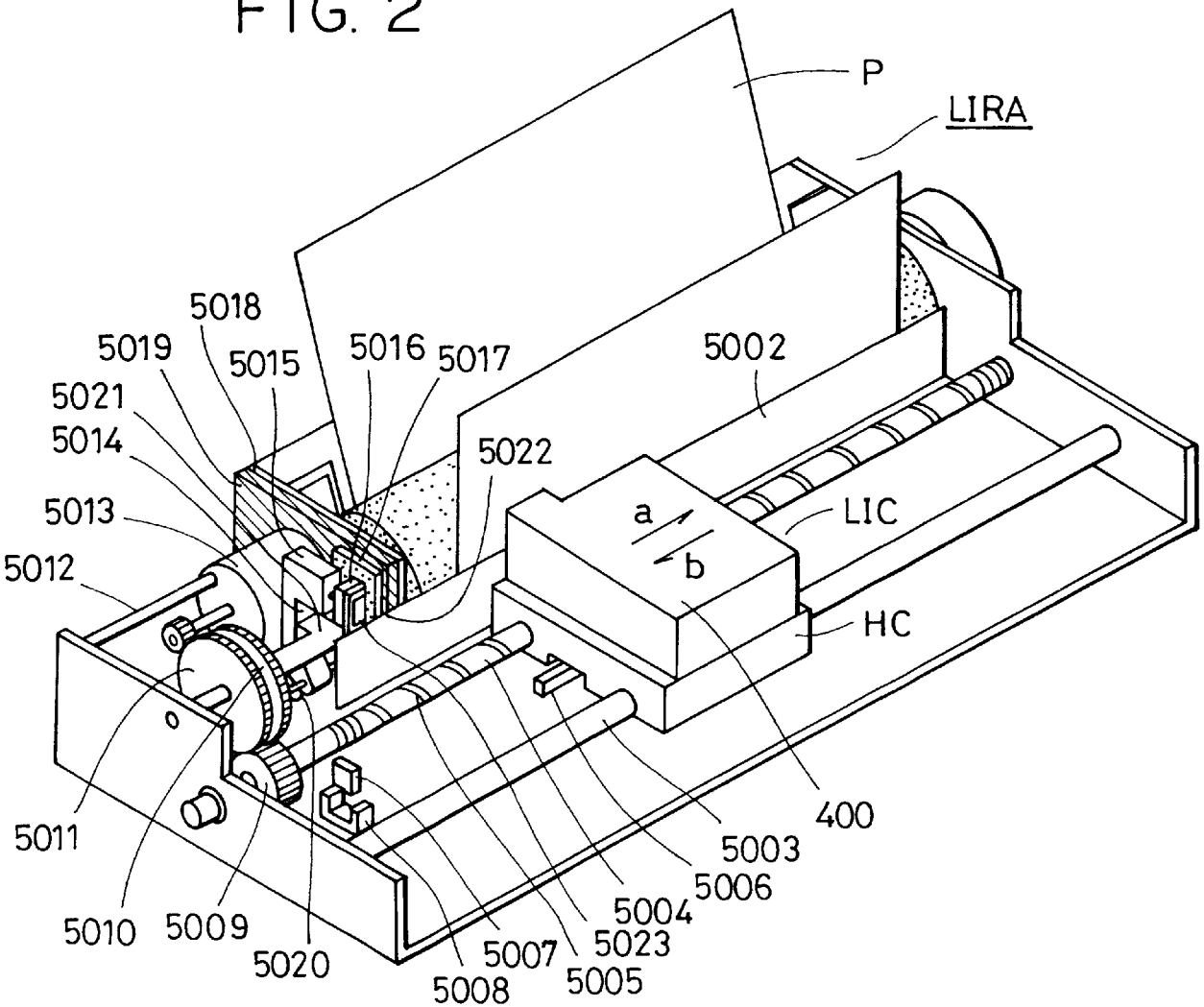
FIG. 2 is a perspective view schematically showing an ink jet apparatus according to this invention.
Figure 3:
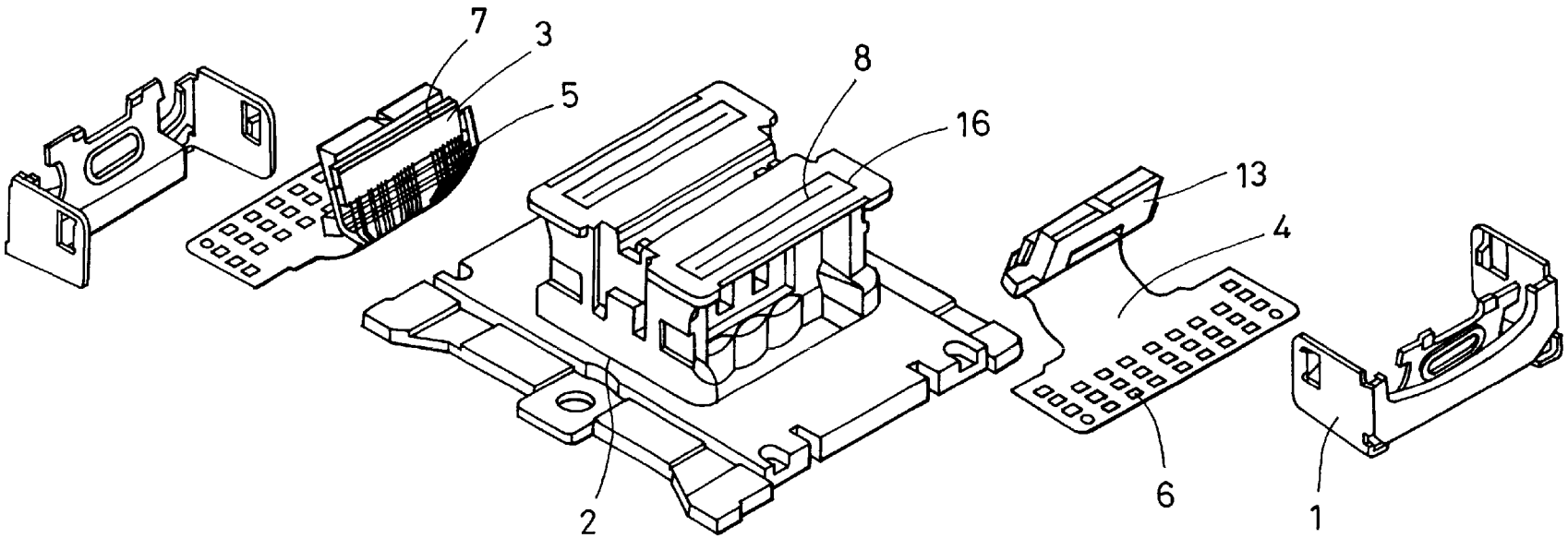
FIG. 3 is an exploded perspective view schematically showing a portion of a conventional ink jet head.
Figure 4:
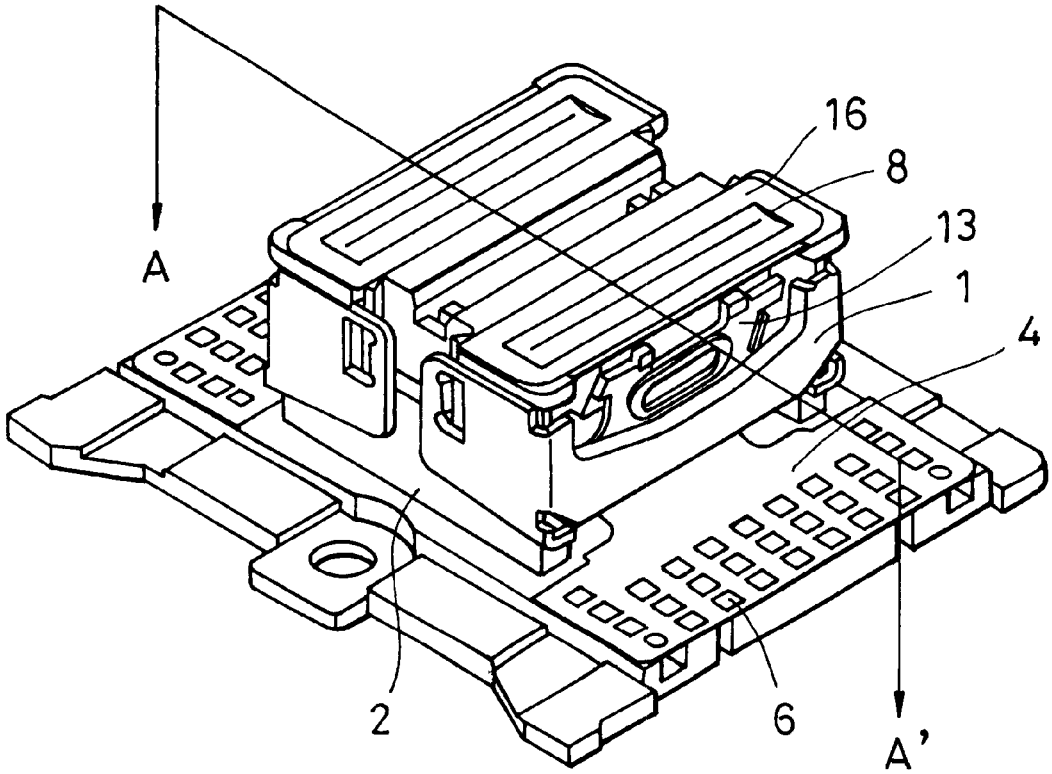
FIG. 4 is a perspective view showing an assembly of a portion of the conventional ink jet head.
Figure 5:
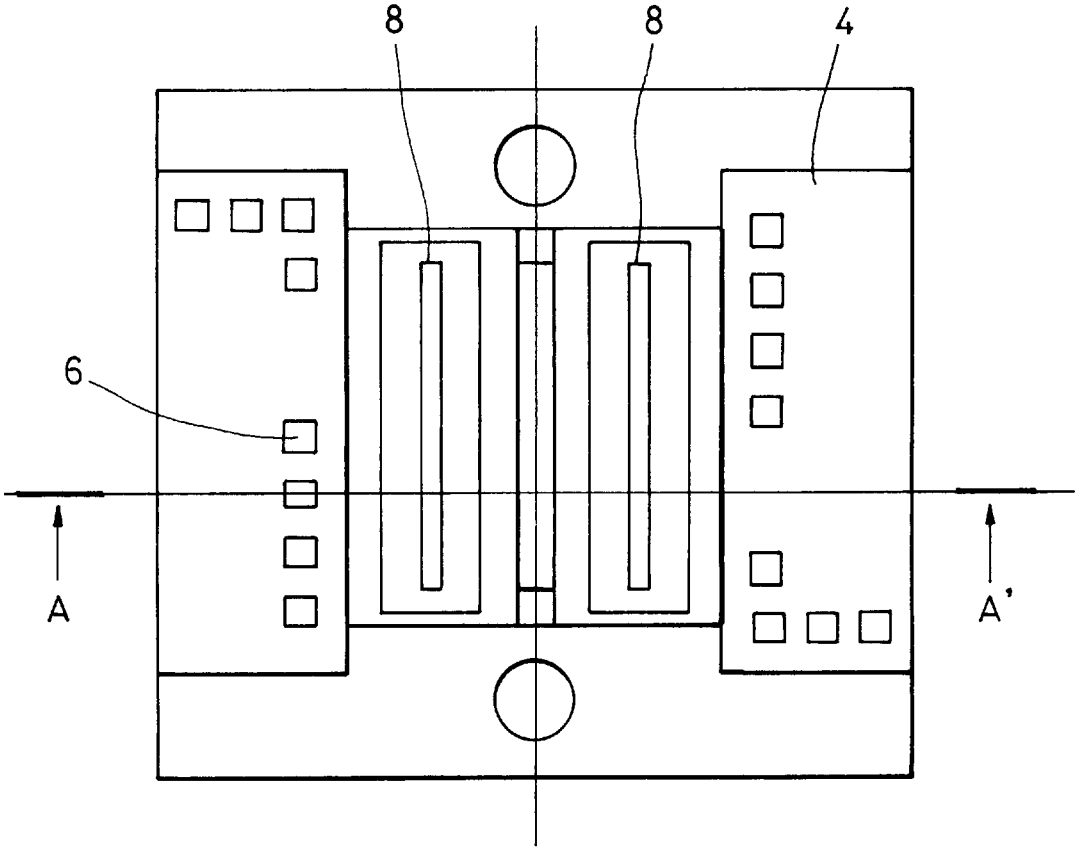
FIG. 5 is a top view showing the conventional ink jet head, viewed from an ejection opening disposition surface.
Figure 6:
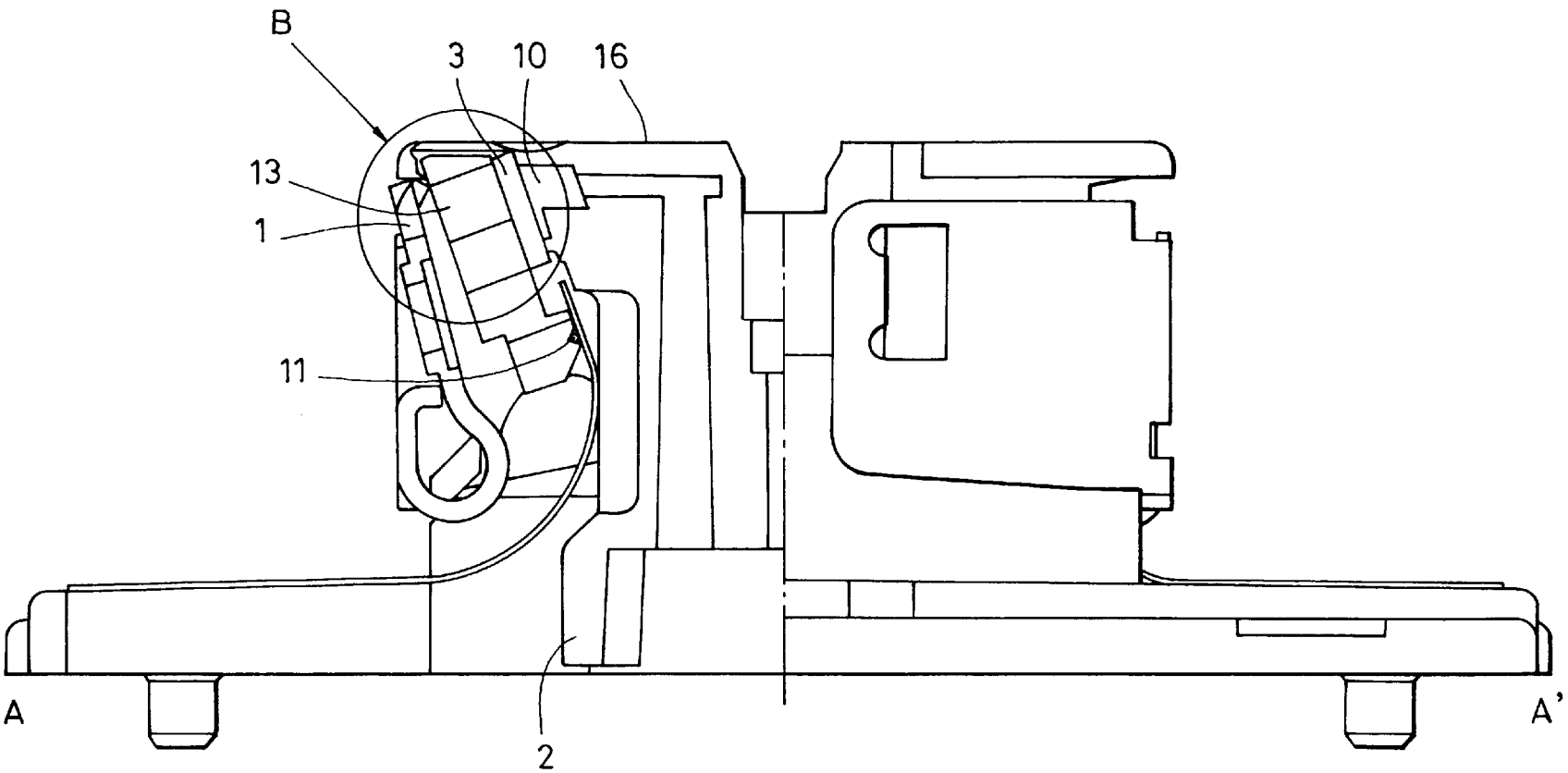
FIG. 6 is a cross-sectional view showing the conventional ink jet head, taken along A–A' line of FIG. 5.
Figure 7:
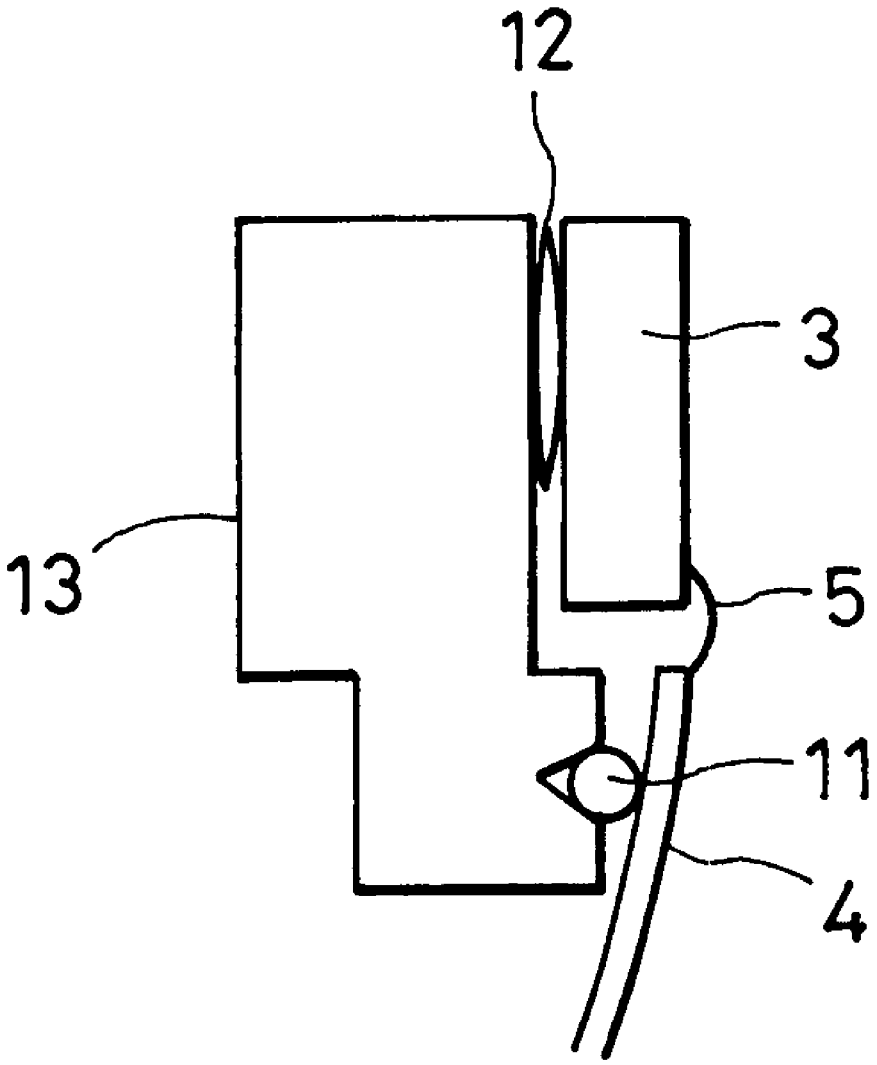
FIG. 7 is an enlarged view showing a joint between a base plate and a supporting member in FIG. 6.
Figure 8:
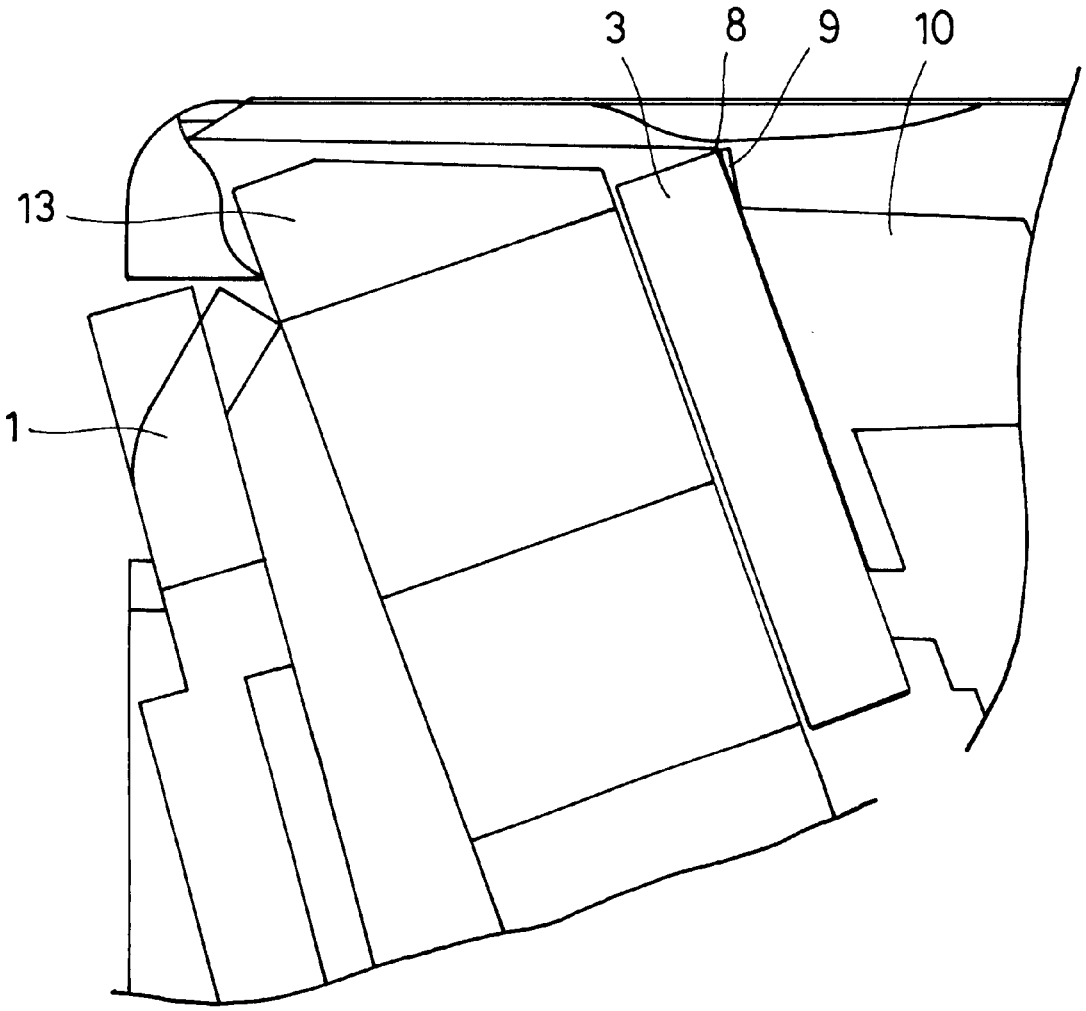
FIG. 8 is a detailed view showing a B portion of the conventional ink jet shown in the A–A' cross section of FIG. 6.
Figure 9:
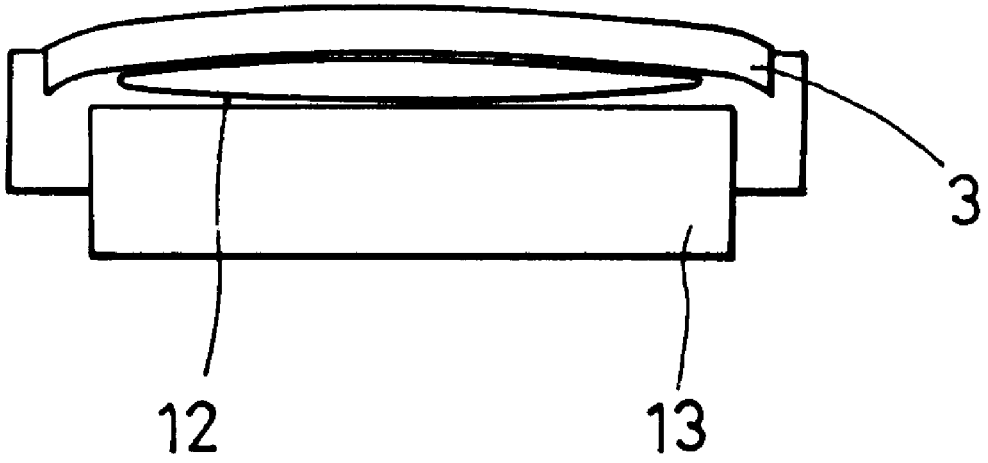
FIG. 9 shows a state in which a base place and a conventional supporting member are joined to each other by a high-temperature cure and brought back to the ordinary temperature, viewed from the ejection opening disposition surface side.
Figure 10A:
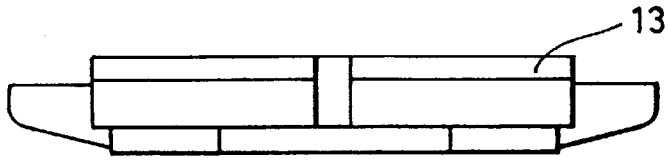
FIG. 10A shows a supporting member of a conventional ink jet head, viewed from the ejection opening disposition surface side.
Figure 10B:
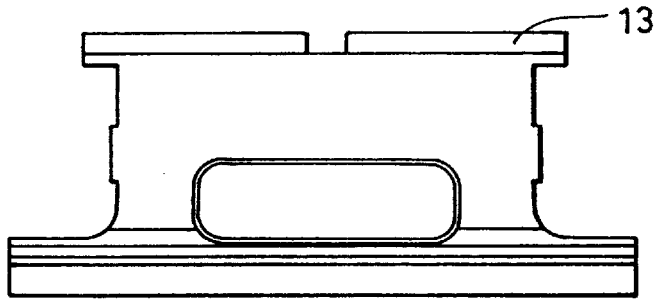
FIG. 10B shows the supporting member of the conventional ink jet head, viewed from a surface thereof contacting with a base plate.
Figure 10C:
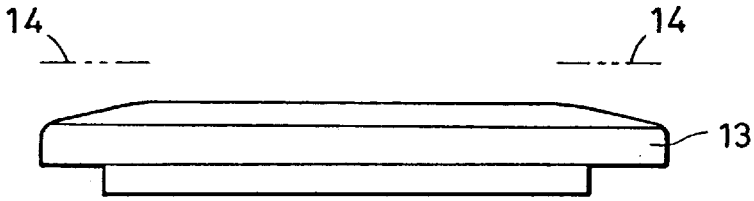
FIG. 10C shows the supporting member of the conventional ink jet head, viewed from a surface opposite to the ejection opening disposition surface.
Figure 10D:
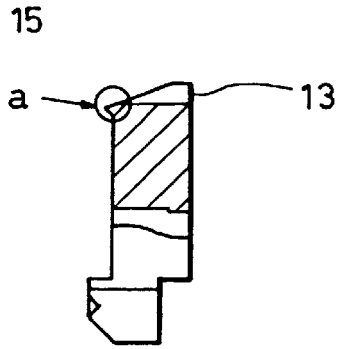
FIG. 10D is a cross-sectional view showing the supporting member of the conventional ink jet head, taken perpendicularly to an ejection energy generating element array.
Figure 10E:
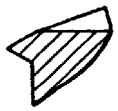
FIG. 10E is an enlarged view of a portion designated as "a" in FIG. 10D.
Figure 11:
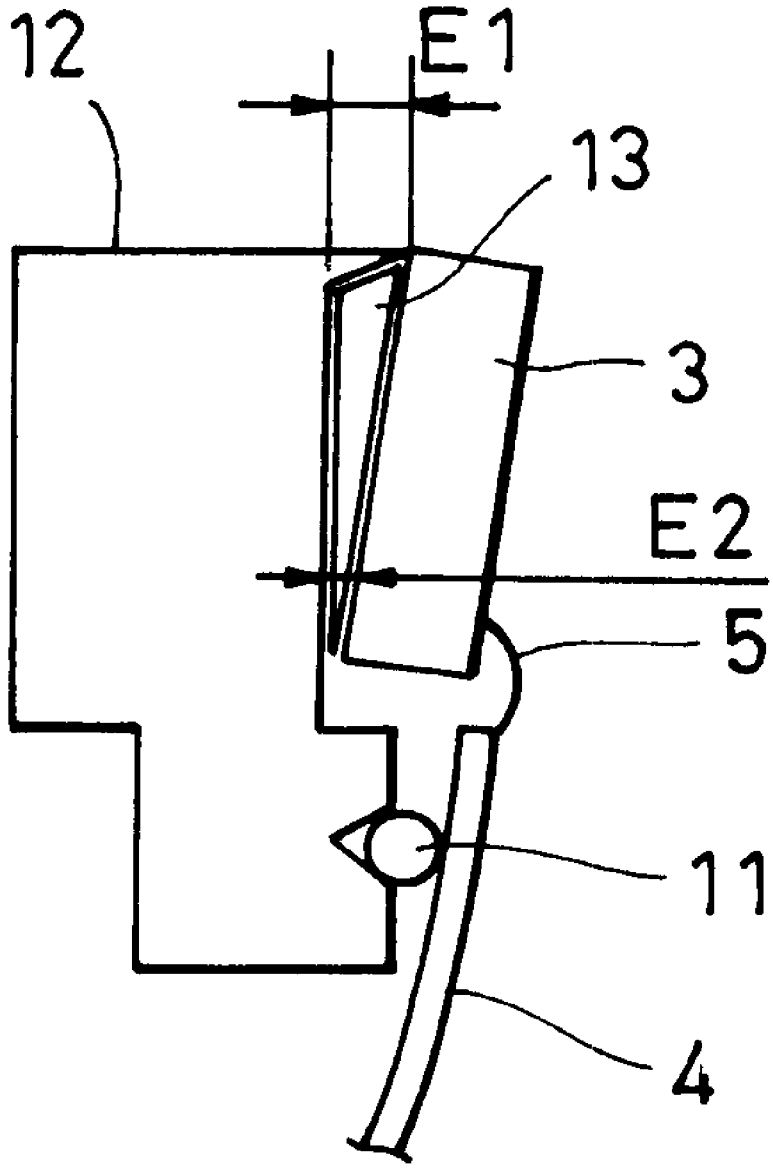
FIG. 11 shows a state of the occurrence of burr on a surface of the supporting member of the conventional ink jet head, contacting with the base plate.

FIG. 2 is a schematic illustration of an ink jet apparatus provided with a carriage carrying a detachable ink jet cartridge equipped integrally with an ink jet head to which this invention is suitably applicable and an ink tank for supplying an ink to the ink jet head, with the carriage being made to conduct scanning operations. Referring to this illustration, a description will be given hereinbelow of each of the components of the ink jet apparatus.

A carriage, which engages with a spiral groove 5004 of a lead screw 5005 made to rotate through driving force transmission gears 5011 and 5009 in connection with the forward/reverse rotation of a drive motor 5013, has a pin (not shown), and is driven to reciprocate in directions indicated by arrows a and b. Numeral 5002 represents a paper pressing plate, which presses paper against a platen 500 throughout carriage moving directions. Numerals 5007 and 5008 denote home-position detecting means for confirming, through the use of photocouplers, that a lever 5006 of the carriage exists at the home position, and for switching the rotating direction of a motor 5013. Numeral 5016 depicts a member for supporting a cap member 5022 which covers the front surface of the ink jet head, and numeral 5015 signifies a suction means for sucking air within the cap 5022 to perform suction restoration of the ink jet head through a cap opening 5023. Additionally, numeral 5017 depicts a cleaning blade, and numeral 5019 denotes a member for allowing the blade 5017 to move in the forward and backward directions, with these being supported by a mainframe 5018. The blade 5017 is not limited to a special one, but a well-known cleaning blade is naturally applicable to this example. Still additionally, numeral 5012 signifies a lever for starting the suction for suction restoration, which moves in conjunction with the movement of a cam 502 engaged with the carriage, and a driving force from the drive motor is controlled through a well-known transmission means such as clutch switching.

These capping, cleaning and suction restoration are made such that, when the carriage reaches the home position side region, desired processing are conducted at the corresponding positions by means of the operations of the lead screw 5005. As long as the desired operations can be conducted at the well-known timings, any configuration is applicable to this example. The constructions stated above are preferable to this invention.

(First Embodiment)

A supporting member according to this invention has been produced according to the following method.

In a first embodiment of this invention, a ceramic burned material to be used as a supporting member was made in a manner that an aluminum oxide, whose degree of purity was 99.99%, was taken out from a molding pattern and was subsequently put in a furnace to be burned at 1500° C. for 40 hours, thereafter shaped into a configuration similar to that of a conventional one.

(Second Embodiment)

In a second embodiment of this invention, an aluminum oxide, whose degree of purity was 90.00%, was used as a ceramic burned material, and was formed in a way similar to that of the aforesaid first embodiment.

(Third Embodiment)

In a third embodiment of this invention, aluminum nitride was used as the ceramic burned material for the supporting member, and the supporting member was produced in a similar method.

Furthermore, 100 supporting members were produced according to each of the first to third embodiments, and the configurations of the surfaces coming into contact with the base plates and the positioning sections were observed in these supporting members.

The observation of the base plate contacting surfaces of the supporting members according to the first to third embodiments showed that the supporting members made according to all the embodiments had uniform molded burned surfaces and positioning sections with no shear drops nor burrs.

Figure 20:
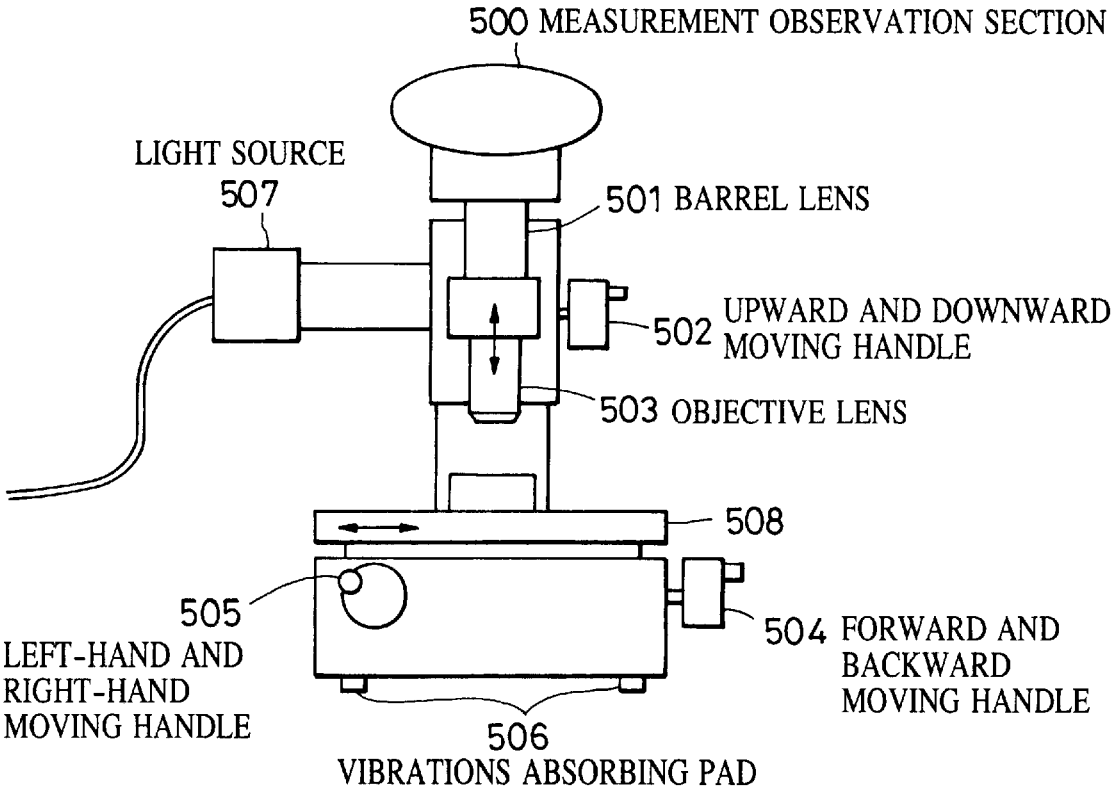
FIG. 20 is a schematic illustration of a metal microscope.

Secondly, in order to check whether or not the supporting members and the base plates could be joined smoothly in parallel with each other, the silicon base plates were measured in the degree (range) of distortion in the ejection energy generating element arranging direction. This measurement was made according to the following method through the use of a dedicated fixing jig and a metal microscope shown in FIG. 20.

Figure 21A:
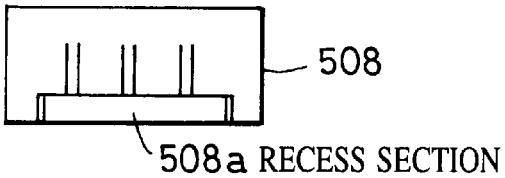
FIG. 21A is a front elevational view for describing a base plate fixing jig.
Figure 21B:
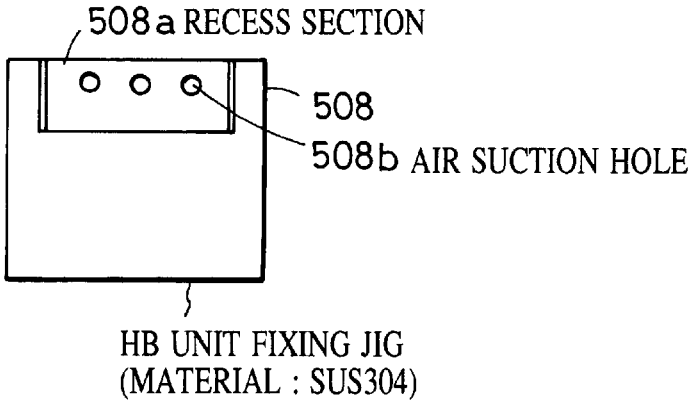
FIG. 21B is a top view for the describing the base plate fixing jig.
Figure 22A:
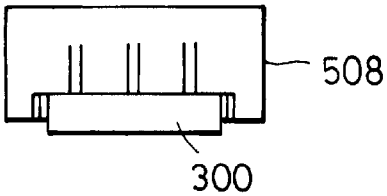
FIG. 22A is a front elevational view showing a state in which the base plate is fixed to the base plate fixing jig.
Figure 22B:
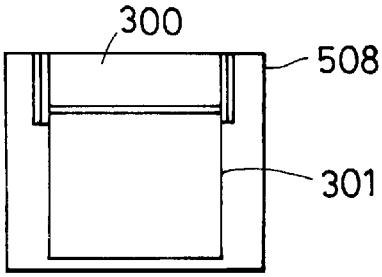
FIG. 22B is a top view showing a state in which the base plate is fixed to the base plate fixing jig

First of all, for measuring the degree of distortion of a base plate 300 in the ejection energy generating element arranging direction prior to the base plate 300 being joined to a supporting member, a surface of the base plate 300 connected to a wiring substrate 301, opposite to the ejection energy generating element disposition surface, was suction-held by a base plate fixing jig 508 shown in FIGS. 21A and 21B and was fixed as shown in FIGS. 22A and 22B. Following this, through the use of the metal microscope, the references were made at both the end portions of the base plate 300 in the ejection energy generating element arranging direction, and of the base plate 300, the most distorted portion was measured. The distortion measured at this time was taken as a distortion F of the base plate 300 in the ejection energy generating element arranging direction prior to being joined to the supporting member.

Incidentally, in the silicon base plate 300, the thickness is approximately 600 $\mu$m, and the length in the ejection energy generating element arranging direction is 14 mm.

Figure 23A:
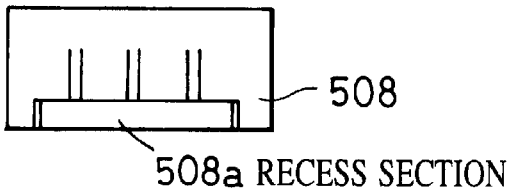
FIG. 23A is a front elevational view for explaining a supporting member fixing jig.
Figure 23B:
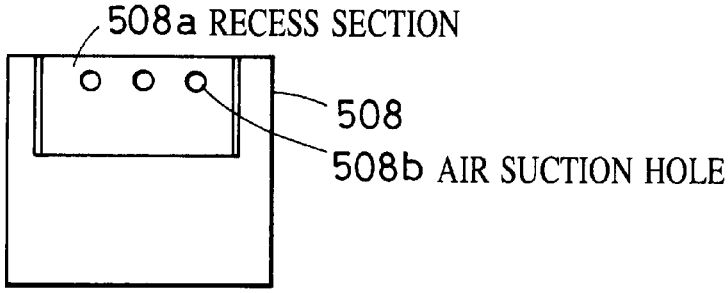
FIG. 23B is a top view for explaining the supporting member fixing jig.
Figure 24A:
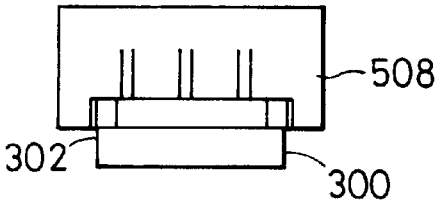
FIG. 24A is a front elevational view showing a state in which a supporting member joined to the base plate by a high-temperature cure is fixed to the supporting member fixing jig.
Figure 24B:
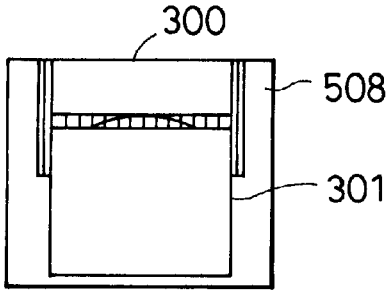
FIG. 24B is a top view showing a state in which the supporting member joined to the base plate by a high-temperature cure is fixed to the supporting member fixing jig.

An Ag containing epoxy adhesive forming a thermal conductivity adhesive was applied onto a base plate 300 contacting surface of each of supporting members 302 being ceramic burned materials produced according to the first to third embodiments, and the supporting member 302 was positioned with respect to the surface opposite to the ejection energy generating element disposition surface of the base plate on which the degree of distortion in the ejection energy generating element arranging direction was measured, and was joined thereto by a high-temperature cure at 120° C. to 150° C. Furthermore, in order to measure the degree of distortion of the base plate 300 in the ejection energy generating element arranging direction after the joining to the supporting member 302 produced according to this invention by the high-temperature cure, the supporting member 302 joined to the base plate 300 was suction-held by a supporting member fixing jig 508 shown in FIGS. 23A and 23B and was fixed as shown in FIGS. 24A and 24B. Thereafter, by using the metal microscope, the references were made at both the end portions of the base plate 300 in the ejection energy generating element arranging direction, and the most distorted portion of the base plate 300 was measured. The distortion measured at this time was taken as a distortion G of the base plate 300 in the ejection energy generating element arranging direction after the base plate 300 was joined to the supporting member 302 through the Ag containing epoxy adhesive forming the thermal conductivity adhesive in a high-temperature curing way.

In the above-mentioned measurements, the difference between the distortion of the base plate 300 in the ejection energy generating element arranging direction after the base plate 300 was joined to supporting member 302 through the Ag containing epoxy adhesive forming the thermal conductivity adhesive in the high-temperature curing way and the distortion of the base plate 300 in the ejection energy generating element arranging direction before it was joined to the supporting member 302, that is, $|G-F|$, signifies a distortion resulting from the difference in coefficient of thermal expansion between the base plate 300 and the supporting member 302. However, at this time, since the distortion F of the base plate 300 in the ejection energy generating element arranging direction before being joined to the supporting member 302 was 0 $\mu$m at all times, the distortion $|G|$ of the base plate 300 in the ejection energy generating element arranging direction after the base plate 300 was joined to the supporting member 302 through the Ag containing epoxy adhesive forming the thermal conductivity adhesive in the high-temperature curing way become the distortion created due to the difference in thermal expansion coefficient between the base plate 300 and the supporting member 302.

The measurement results of the ejection energy generating element arranging direction distortion of the base plates joined through a thermal conductivity resin to the supporting members produced according to the first to third embodiments, obtained by the above-mentioned measurements, are as follows.

First, in the case of the first embodiment, the range of the distortion of the base plate in the ejection energy generating element arranging direction was 0 $\mu$m to 3 $\mu$m. In the case of the second embodiment, the range of the distortion of the base plate in the ejection energy generating element arranging direction was 0 $\mu$m to 3 $\mu$m. Furthermore, in the case of the third embodiment, the distortion of the base plate in the ejection energy generating element arranging direction was 0 $\mu$m.

Moreover, as a comparative example, a supporting member was made in a manner that aluminum was formed by pressing, and an Ag containing epoxy adhesive was applied onto a surface of the supporting member contacting with a base plate, and further the supporting member was joined to a surface of the silicon-made base plate opposite to the surface on which ejection energy generating elements were disposed, and cured at a high temperature of 120° C. to 150° C.

As the result of the observation of this supporting member made from aluminum showed that shear drops or burrs occurred on the surface contacting with the base plate or the positioning section, because it was processed by pressing.

In addition, the ejection energy generating element arranging direction distortion of the base plate joined to the supporting member made from aluminum was measured as well as the cases of the first and third embodiments, and the range of the ejection energy generating element arranging direction distortion of the base plate was 0 $\mu$m to 15 $\mu$m.

From the above measurement results, it was conformed that, as compared with the conventional one, the supporting member according to this invention had no shear drops nor burrs on its surface contacting with the base plate and also had no shear drops nor burrs at the positioning section. Additionally, it was confirmed that the ejection energy generating element arranging direction distortion of the silicon base plate joined to the supporting member through the Ag containing epoxy adhesive forming the thermal conductivity adhesive in a high-temperature curing way reduced as compared sharply with the conventional technique.

Moreover, when an ink jet head was produced using the supporting member made according to the first to third embodiments and the ink ejection was made, it was possible to achieve high-quality recording without causing the occurrence of poor ink impact on a record medium.

It should be understood that the foregoing relates to only preferred embodiments of the present invention, and that it is intended to cover all changes and modifications of the embodiments of the invention herein used for the purpose of the disclosure, which do not constitute departures from the spirit and scope of the invention.

What is claimed is:

1. An ink jet head comprising:

a top plate having grooves for forming a plurality of ink passages in an arranged condition and a recess section for forming a liquid chamber communicating with said ink passages;

a base plate for establishing said plurality of ink passages and said liquid chamber in a state joined to said top plate;

ejection energy generating elements placed on said base plate for ejecting an ink; and a supporting member for supporting a surface of said base plate opposite to a surface thereof on which said ejection energy generating elements are placed, wherein said supporting member is made of a ceramic burned material.

2. An ink jet head according to claim 1, wherein said supporting member has a high thermal conductivity.

3. An ink jet head according to claim 1, wherein said supporting member is made of aluminum oxide.

4. An ink jet head according to claim 3, wherein the purity of said aluminum oxide is above 80%.

5. An ink jet head according to claim 1, wherein said supporting member is made of aluminum nitride.

6. An ink jet head according to claim 1, wherein said supporting member is joined to said base plate through a thermal conductivity adhesive.

7. An ink jet head according to claim 6, wherein said thermal conductivity adhesive is an Ag containing epoxy adhesive.

8. An ink jet head according to claim 1, wherein said supporting member has a positioning section for positioning said base plate with respect to said top plate.

9. An ink jet head according to claim 1, wherein said supporting member has a positioning section for mounting in an ink jet apparatus.

10. An ink jet head according to claim 1, wherein each of said ejection energy generating elements is an electrothermal converting element for generating thermal energy.

11. An ink jet head according to claim 1, wherein said top plate is equipped with an orifice plate having a plurality of ejection openings arranged to communicate with said ink passages for ejecting said ink.

12. An ink jet head according to claim 11, wherein said plurality of ejection openings are formed in a state arranged in parallel with each other.

13. An ink jet head according to claim 1, further comprising a wiring substrate joined electrically to said base plate so that said wiring substrate is connected electrically to said ejection energy generating elements.

14. An ink jet head according to claim 13, wherein said wiring substrate is composed of a flexible cable and is joined to said supporting member through a UV adhesive.

15. An ink jet head according to claim 1, wherein a sealing material is placed around said top plate and around said base plate.

16. An ink jet head according to claim 1, further comprising a pressing member for pressing said top plate and said base plate so that said top plate and said base plate are fixed to each other.

17. An ink jet head according to claim 16, wherein said pressing member has an elasticity.

18. An ink jet head according to claim 16, wherein said pressing member is made of a metal, and is brought into contact with said supporting member.

19. An ink jet head according to claim 16, wherein said pressing member is made to press said top plate in a state where said base plate is interposed therebetween.

20. An ink jet head according to claim 1, wherein said top plate is formed by molding a resin.

21. An ink jet head according to claim 1, wherein said top plate is made of silicon.

22. An ink jet head according to claim 1, wherein said base plate is made of silicon.

23. An ink jet cartridge integrally including an ink jet head as defined in any one of claims 1 to 21 and an ink tank for supplying an ink to said ink jet head.

24. An ink jet apparatus comprising:

an ink jet cartridge according to claim 23;

a carriage on which said ink jet cartridge is mounted detachably, said carriage being made to conduct a scanning operation.

25. An ink jet head according to claim 1, wherein said supporting member is burned at a temperature of at least 1500° C.

26. An ink jet head according to claim 1, wherein a thickness of said supporting member is not uniform.

27. A method of manufacturing an ink jet head made up of a top plate having grooves for forming a plurality of ink passages in an arranged condition and a recess section for forming a liquid chamber communicating with said ink passages, a base plate for establishing said plurality of ink passages and said liquid chamber in a state joined to said top plate, ejection energy generating elements placed on said base plate for ejecting an ink, and a supporting member for supporting a surface of said base plate opposite to a surface thereof on which said ejection energy generating elements are placed, said method comprising a step of producing said supporting member by burning a ceramic material after the ceramic material is formed by molding.

28. An ink jet head manufacturing method according to claim 27, wherein said supporting member is formed using a ceramic burned material having a high thermal conductivity.

29. An ink jet head manufacturing method according to claim 27, wherein said supporting member is made of aluminum oxide.

30. An ink jet head manufacturing method according to claim 29, wherein the purity of said aluminum oxide is above 80%.

31. An ink jet head manufacturing method according to claim 27, wherein said supporting member is made of aluminum nitride.

32. An ink jet head manufacturing method according to claim 27, wherein said supporting member is formed by one of extrusion molding and injection molding.

33. An ink jet head manufacturing method according to claim 27, further comprising a step of joining said supporting member to a surface of said base plate opposite to a surface thereof on which said ejection energy generating elements are placed.

34. An ink jet head manufacturing method according to claim 33, wherein the joining between said supporting member and said base plate is made by curing a thermal conductivity adhesive at a high temperature.

35. An ink jet head manufacturing method according to claim 34, wherein said thermal conductivity adhesive is an Ag containing epoxy adhesive.

36. An ink jet head manufacturing method according to claim 27, wherein a positioning section provided in said supporting member for positioning said base plate with respect to said top plate is formed during the molding.

37. An ink jet head manufacturing method according to claim 27, wherein a positioning section provided in said supporting member for mounting said ink jet head in an ink jet apparatus is formed during the molding.

38. An ink jet head manufacturing method according to claim 27, wherein each of said ejection energy generating elements is an electrothermal converting element for generating thermal energy.

39. An ink jet head manufacturing method according to claim 27, wherein said top plate is equipped with an orifice plate having a plurality of ejection openings arranged to communicate with said ink passages for ejecting said ink.

40. An ink jet head manufacturing method according to claim 39, wherein said plurality of ejection openings are formed in a state arranged in parallel with each other.

41. An ink jet head manufacturing method according to claim 27, wherein said ink jet head further includes a wiring substrate joined electrically to said base plate so that said wiring substrate is connected electrically to said ejection energy generating elements.

42. An ink jet head manufacturing method according to claim 41, wherein said wiring substrate is composed of a flexible cable and is joined to said supporting member through a UV adhesive.

43. An ink jet head manufacturing method according to claim 27, wherein a sealing material is placed around said top plate and around said base plate.

44. An ink jet head manufacturing method according to claim 27, wherein said ink jet head further includes a pressing member for pressing said top plate and said base plate so that said top plate and said base plate are fixed to each other.

45. An ink jet head manufacturing method according to claim 44, wherein said pressing member has an elasticity.

46. An ink jet head manufacturing method according to claim 44, wherein said pressing member is made of a metal, and is brought into contact with said supporting member.

47. An ink jet head manufacturing method according to claim 44, wherein said pressing member is made to press said top plate in a state where said base plate is interposed therebetween.

48. An ink jet head manufacturing method according to claim 27, wherein said top plate is formed by molding a resin.

49. An ink jet head manufacturing method according to claim 27, wherein said top plate is made of silicon.

50. An ink jet head manufacturing method according to claim 27, wherein said base plate is made of silicon.

51. An ink jet head manufacturing method according to claim 27, wherein the supporting member is burned at a temperature of at least 1500° C.

52. An ink jet head manufacturing method according to claim 27, wherein a thickness of the supporting member is not uniform.

* * * * *